United States Patent [19]

Hein et al.

[11] 4,374,442

[45] Feb. 22, 1983

[54] EXPANSION JOINT SEALING ASSEMBLY FOR CURB AND ROADWAY INTERSECTIONS

[75] Inventors: Richard D. Hein; William L. Fleshood, both of Wabash, Ind.

[73] Assignee: The General Tire & Rubber Company, Akron, Ohio

[21] Appl. No.: 287,347

[22] Filed: Jul. 27, 1981

[51] Int. Cl.[3] ..... E01D 19/06; E01C 11/02

[52] U.S. Cl. ..... 14/16.5; 404/47; 404/65; 404/69

[58] Field of Search ..... 404/47, 64, 65, 68, 404/69, 32, 44, 67; 52/396; 49/475; 14/16.5

[56] References Cited

U.S. PATENT DOCUMENTS

| | | | |
|---|---|---|---|
| 3,713,368 | 1/1973 | McDowell | 404/67 |
| 3,827,817 | 8/1974 | Czernik | 404/67 |
| 3,880,541 | 4/1975 | McDowell | 52/396 X |
| 3,992,121 | 11/1976 | Geiger | 404/47 |
| 4,063,840 | 12/1977 | Fordyce | 14/16.5 X |
| 4,111,583 | 9/1978 | Brady | 14/16.5 X |
| 4,140,419 | 2/1979 | Puccio | 404/69 |
| 4,295,315 | 10/1981 | Jones | 14/16.5 X |
| 4,307,974 | 12/1981 | George | 404/68 |

*Primary Examiner*—Nile C. Byers, Jr.

[57] ABSTRACT

An expansion joint sealing assembly of the type employing a flexible membrane extending between two relatively rigid elongated elastomeric pads is adapted to seal the gap in the area where a curb and roadway portion of the deck intersect. The assembly is especially useful in situations where the gap extends at a skew angle across the roadway, so that the line of intersection between the curb and roadway portions of the deck, along which the sealing assembly must be bent, is not perpendicular to the longitudinal dimension of the sealing assembly. This creates a complex bending angle for the flexible membrane portion of the seal. In brief terms, the problem is solved by providing laterally extending convolutions in the side edge portions of the membrane and a locking rib on the top of each convolution which fits into an appropriate slot in the elastomeric pad to which each side edge portion of the membrane is connected.

3 Claims, 6 Drawing Figures

EXPANSION JOINT SEALING ASSEMBLY FOR CURB AND ROADWAY INTERSECTIONS

This invention relates to an expansion joint sealing assembly for sealing the gap between adjacent deck sections of an elevated structure. More particularly, the invention relates to a sealing assembly that employs a flexible membrane, and is especially designed to seal an expansion gap in the area where vertical curb and horizontal roadway portions of the deck intersect.

One common construction of an expansion joint sealing assembly comprises an elongated flexible membrane that extends over a gap between two deck sections and is anchored at its longitudinal edges to relatively rigid, elongated pads that sit on the deck sections and extend along either side of the gap. The flexible membrane may be of a cellular structure, as shown in U.S. Pat. No. 4,063,840 to Fordyce et al and assigned to the assignee of the present invention, or the membrane may be of a single layer, folded to form one or more longitudinally extending convolutions, as shown in U.S. Pat. No. 3,713,368 to McDowell et al.; U.S. Pat. No. 3,827,817 to Czernik; and U.S. Pat. No. 3,992,121 to Geiger. Also, the flexible membrane may be molded as an integral part of the two relatively rigid elongated pads that sit on the deck sections, as shown in all of the patents mentioned above, or it may be a separate part that has upwardly extending longitudinal ribs along its side edges, held in downwardly facing longitudinal grooves in the two relatively rigid elongated pads. An example of the latter construction is illustrated in FIG. 2 of the attached drawings.

Sometimes, a flexible membrane seal of the type described above must extend over a roadway expansion gap in the area where a vertical curb intersects a horizontal roadway. This presents a difficult sealing problem, particularly if the gap between the deck sections extends at a skew angle to the curb, rather than perpendicular to it. With such a skew angle, the flexible membrane must not only bend along a line extending from one side of the membrane to the other, but it must at the same time rotate through an angle equal to the skew angle of the gap. Furthermore, the membrane must be constructed so that its side edges remain in sealing engagement between the deck sections and the elongated pads while the gap narrows and widens as the result of the expansion and contraction of the deck sections.

U.S. Pat. No. 3,184,530 to Neff and U.S. Pat. No. 3,880,541 to McDowell et al., show two known constructions of flexible membrane sealing assemblies designed to be bent around curb and roadway intersections at which the expansion gap is at a skew angle to the curb. In both of these patents, the membrane is in the form of a flexible sheet that is attached to two elongated pads that extend up the curb on either side of the gap. The sheet has a flap portion that extends longitudinally beyond the ends of the pads and out onto the roadway portion of the expansion joint. The flap shown in U.S. Pat. No. 3,814,530 is cut so that it extends at the proper skew angle corresponding to the skew of the gap with respect to the curb, while the flap of U.S. Pat. No. 3,880,541 has bulging portions that allow the flap to be turned at a variety of skew angles. In both cases, elongated pads are placed over the side edges of the flap portion, and the pads are bolted down on the roadway portions of the deck sections, to secure the flap to between the deck sections and the pads. In the construction of U.S. Pat. No. 3,880,541, the bulging portions of the flap are folded to make them lie as flat as possible over the other parts of the flap, prior to securing the elongated pads on top of the flap.

A problem with both the flap-type membranes shown in the foregoing patents is that the side edges of the flap are not very securely anchored to the pads on the roadway portions of the deck sections. As the expansion gap narrows and widens and traffic travels over the membrane, the flap can be pulled out from between the elongated pads and the deck sections or at least moved with respect to the pads. Also, water can leak between the flap and the pads, particularly if folded bulges are used that create humps that make it impossible to seat the pads evenly on top of the flap edges. In addition, the flaps are not easily adapted to be secured to gaps placed at a wide variety of skew angles. The membrane flap of U.S. Pat. No. 3,814,530 must be cut at the factory to fit only one skew angle, while the bulging portions of the membrane flap of U.S. Pat. No. 3,880,541 must be limited in size if they are not to leave too much material folded over when installed over gaps having small skew angles. The bulging portions must thus be made progressively larger for membrane flaps designed for larger skew angles.

An object of the present invention is to provide an expansion joint sealing assembly of the flexible membrane type designed for sealing a gap that extends at a skew angle between adjacent deck sections at the intersection of the curb and roadway portions of the deck sections, wherein the membrane is more firmly anchored to and in better sealing engagement with the elongated pads holding down the side edges of the membrane, than in previously known constructions of such sealing assemblies.

A further object of the present invention is to provide an expansion joint sealing assembly of the type described above which is capable of being installed over gaps extending at a wide variety of skew angles to the curb portion of the deck sections.

The present invention accomplishes these and other objects by a construction that includes a first pair of elongated elastomeric pads designed for placement on the roadway portions of the deck sections along opposite sides of an expansion gap, a second pair of elongated elastomeric pads designed for placement on the curb portions of the deck sections on opposite sides of the gap, and an elongated flexible membrane member designed to extend across the gap between both the curb portions and the roadway portions of the deck sections. The flexible membrane member has longitudinally extending side edge portions designed to be secured between both pairs of pads and both portions of the deck sections. Bolts or other fastening means are provided to secure the elongated pads to the deck sections, with the side edge portions of the membrane member held between the pads and the deck sections. The sealing assembly of the present invention is characterized by the improvement comprising the side edge portions of the flexible membrane member each having molded convolutions with laterally extending axes, with each of the convolutions having an upwardly facing first rounded portion with a locking rib projecting upwardly from this first rounded portion. Each of these locking ribs extend longitudinally of said membrane member and is separated from adjacent locking ribs by downwardly facing second rounded portions of the convolutions. In addition, each elongated elastomeric pad has downwardly facing slots extending longitudinally of the pad so that the locking ribs on the membrane member fit within said slots in the pads to hold the convoluted side edge portions of the membrane member in place between the pads and the deck sections.

In the preferred embodiment, the present invention is also characterized by a closed-cell sponge filling affixed to the underside surfaces of the convolutions in the side edge portions of the flexible membrane member. The underside of this sponge filling is designed for sealing contact with the deck section portions.

Also, there are two molded convolutions with longitudinally extending axes in the central part of the membrane member that is designed to extend over said gap between the roadway portions of said deck sections. These molded convolutions with longitudinally extending axes diverge away from one another toward the area of the membrane that is designed to extend over the gap in the location where the curb and roadway portions of the deck sections intersect. In this area of the membrane, at least one additional molded convolution with a longitudinally extending axis is spaced between the first mentioned molded convolutions with longitudinally extending axes.

The foregoing objects, features and advantages of the present invention will be more apparent from the following detailed description and the attached drawings, in which.

Figure 1:
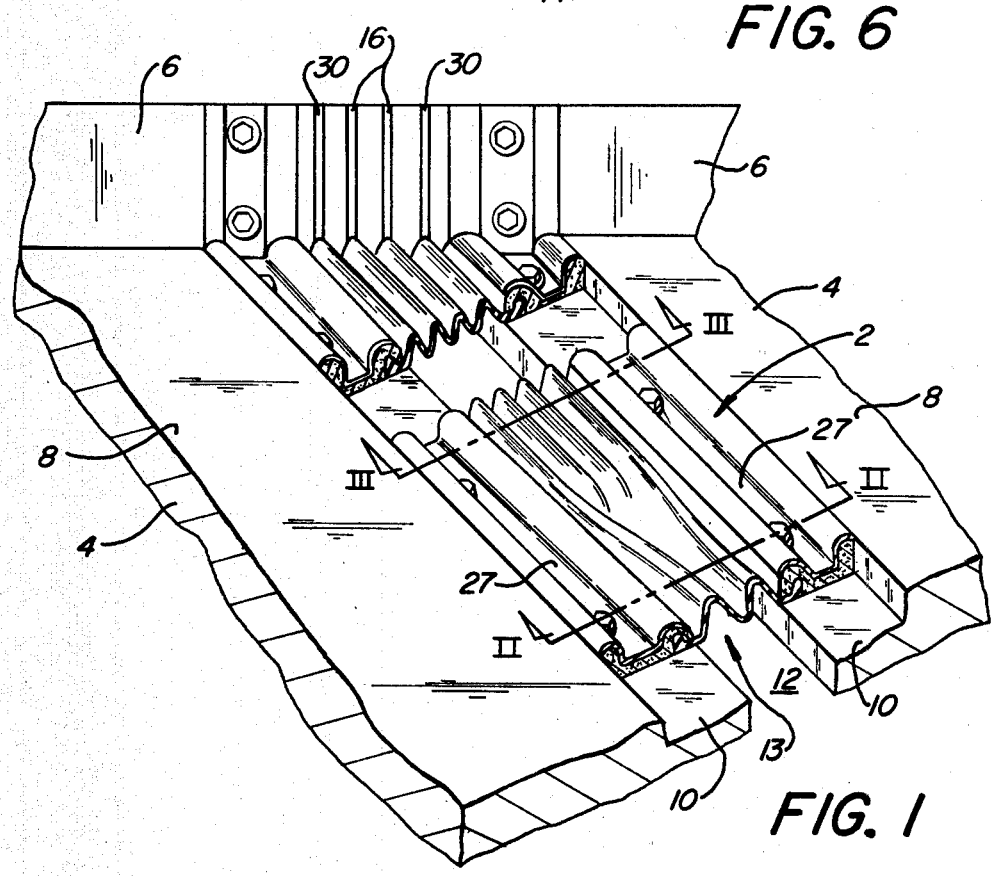
FIG. 1 is a perspective view of adjacent deck sections having intersecting curb and roadway positions, and showing the expansion gap between these deck sections sealed by a joint sealing assembly constructed according to the present invention, with a mid-portion of the assembly broken out to better illustrate its construction.

In the perspective view of FIG. 1, an expansion joint sealing assembly 2 is shown installed on roadway deck sections 4 that have vertical curb portions 6 and horizontal roadway portions 8. In both the curb portions 6 and the roadway portions 8, there are recesses 10 adjacent an expansion gap 12 that extends between the deck sections 4.

The portion of the sealing assembly 2 furthest from the curb portions 6, has a cross-section 13 identical to the cross-section of prior known flexible membrane sealing assemblies. This portion of the sealing assembly 2 is designed to mate with the end of a sealing assembly of similar cross-section that extends over the gap 12 and across the roadway portions 8 to another curb area on the other side of the road. The cross-section 13 of the sealing assembly 2 is shown in detail in FIG. 2 and includes a thin, flexible membrane 14, preferably made of Neoprene. The membrane 14 has two upstanding convolutions 16 with longitudinally extending axes in its central part, and two longitudinally extending locking ribs 18 in its side edge portions. The locking ribs 18 mate with downwardly facing slots 20 in elongated elastomeric pads 22 that are secured in the recesses 10 of deck sections 4 by anchor bolts 24. The elongated elastomeric pads 22 are relatively rigid compared to the flexible membrane 14 and are made even more rigid by their being covered by a contoured cover plates 26. The heads 25 of bolts 24 are secured over the cover plates 26 in longitudinally extending recesses 27 of the cover plates, and the bolts 24 extend through holes 28 in the cover plates 26 and elastomeric pads 22, and into the concrete deck sections 4. The anchor bolts 24 are secured in threaded anchor collars that are embedded in the deck sections 4 but are not shown in the drawings. When the bolt heads 25 are tightened against the cover plates 26, the locking ribs 18 of the membrane 14 are compressed between the slots 20 of pads 22 and the surfaces of the deck sections 4, thus holding both sides of the flexible membrane 14 firmly in place on the deck sections 4.

Figure 6:
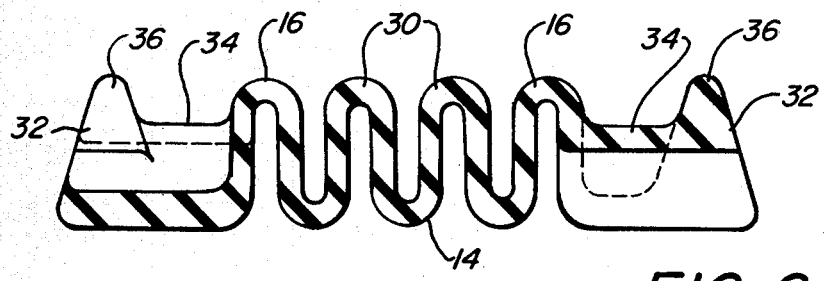
FIG. 6 is a cross-sectional view of the flexible membrane member shown in FIGS. 4 and 5, taken along line VI—VI of FIG. 4.
Figure 3:
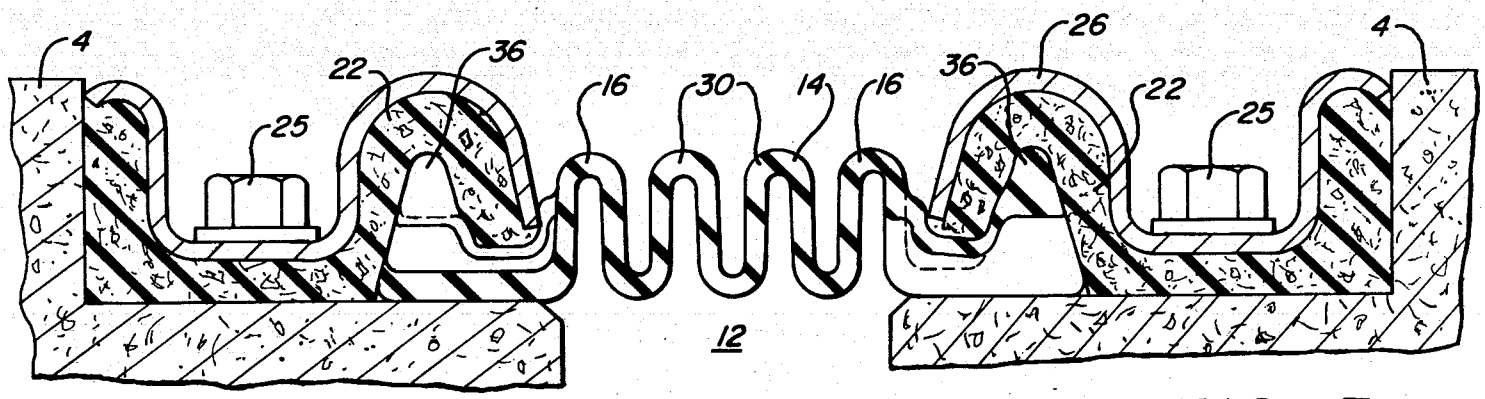
FIG. 3 is another cross-sectional view of the expansion joint sealing assembly of FIG. 1, taken along line III—III of FIG. 1.
Figure 2:
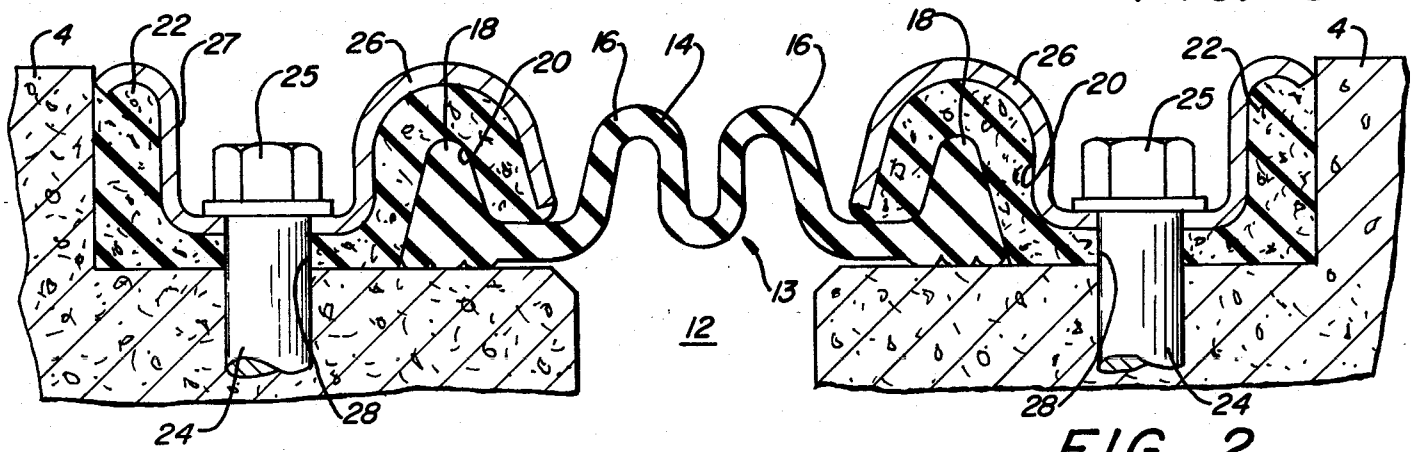
FIG. 2 is a cross-sectional view of the expansion joint sealing assembly of FIG. 1, taken along line II—II of FIG. 1.
Figure 4:
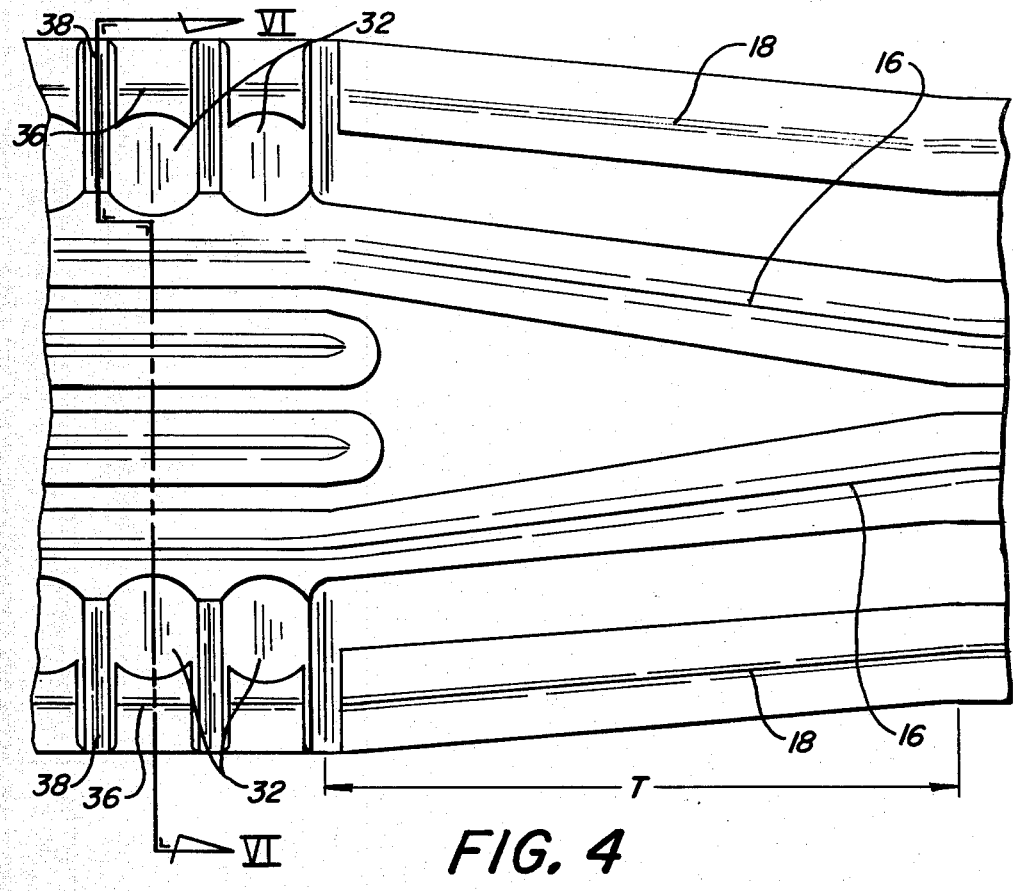
FIG. 4 is a top view of the flexible membrane member that forms a part of the expansion joint sealing assembly of FIG. 1.
Figure 5:
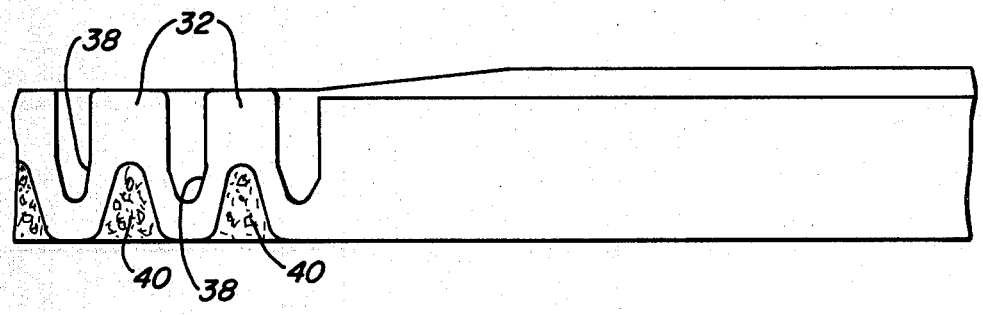
FIG. 5 is a side view of the flexible membrane member shown in FIG. 4.

Throughout the length of the sealing assembly 2 on both the roadway portions 8 and the curb portions 6 of the deck sections 4, the elongated pads 22 and their cover plates 26 retain the same cross-section. However, near the intersection of the curb portion 6 with the roadway portion 8 of the deck sections 4, the construction of the flexible membrane 14 changes considerably. FIGS. 4, 5, and 6 show the flexible membrane 14 before it is assembled with the other parts of the sealing assembly 2. As shown in FIG. 4, the two longitudinally extending convolutions 16 diverge away from each other in a transition area T of the membrane 14. The locking ribs 18 in the side edge portions of the membrane 14 also diverge away from each other in the transition area T when the membrane is in its unassembled stage, but when the membrane 14 is assembled with the elastomeric pads 22 as shown in FIGS. 1-3, it is stretched so that the locking ribs 18 do not diverge from each other. The position of the locking ribs 18 when the flexible membrane 14 is assembled with the pads 22 is controlled by the engagement of these ribs in the slots 20 of the pads 22 which are firmly bolted to the deck sections 4.

In the area of the flexible membrane 14 that is designed to be bent around the intersection between the curb portion 6 and the roadway portion 8, additional longitudinally extending convolutions 30 are spaced between the diverged convolutions 16. This results in 4 convolutions extending across the gap 12 as shown in the cross-section of FIG. 3.

Also, in the area of the membrane 14 designed to be bent around the intersection of the curb and roadway portions of the deck sections 4, the side edge portions of the membrane have a series of convolutions 32 with laterally extending axes. On the upwardly facing rounded portion 34 of each of the convolutions 32 is an upwardly projecting locking rib 36. Each locking rib 36 extends longitudinally of the membrane 14 and is separated from adjacent locking ribs by the downwardly facing rounded portions 38 of the convolutions 32 (FIGS. 4 and 5). Preferably, each laterally extending convolution 32 has affixed to its underside surface a closed-cell, neoprene sponge seal 40 (FIG. 5). The underside of the sponge filling 40 is designed for sealing contact with the deck sections 4.

In a typical embodiment of the invention, the portion of the sealing assembly 2 with the cross-section 13 (FIG. 2) would be 1.75 inches (44.5 mm), the transition area T is 4.12 inches (104.6 mm), and the portion that extends from the transition area T around the curb and roadway intersection and up the curb is 24 inches (609.6 mm) and has 32 laterally extending convolutions 32 on each side edge portion.

When the sealing assembly 2 is installed across the gap 12 between the deck sections 4, the membrane 16 is first laid across the gap with its continuous locking ribs 18 and interrupted locking ribs 36 lying on the horizontal surfaces of the recesses 10 of the deck sections 4 adjacent the gap 12. The portion of the membrane 14 facing away from the curb portions 6 of the deck sections that has the conventional cross section shown in FIG. 2 is usually heat sealed in the factory to another section of the membrane designed to extend across the central area of the roadway. At the intersection of the roadway portion 8 and curb portion 6 of the deck sections 4, the flexible membrane 14 with its four longitudinally extending convolutions 16 and the laterally extending convolutions 32 is bent so that it travels upwardly along the gap 12 between the curb portion 6. Due to the skew angle to the gap 12 in respect to the curb portions 6, the membrane 14 is not only bent upwardly, but the laterally extending convolutions 32 on one of its side edge portions are compressed while the laterally extending convolutions 32 on its other side edge portion are extended to make up for the difference in the linear distance covered by the two side edge portions of the membrane 14 at the intersection of the curb portion 6 with the roadway portion 8.

With the flexible membrane 14 thus in place, the elongated elastomeric pads 22, with their cover plates 26 extending over their upwardly facing surfaces, are laid on top of the side edge portions of the membrane 14 so that the longitudinally extending ribs 18 and 32 sit snugly within the downwardly facing slots 20 of the pads 22. The elastomeric pads 22 and plates 26 are precut in the factory at bevelled angles at their ends which butt against each other at the intersection of the roadway portion 8 with the curb portion 6. The pads 22 thus cover completely the ribs 18 and 32 of the membrane 14 and hold the side edge portions of the membrane clamped firmly throughout their lengths to the recessed portions 10 of deck sections 4.

When thus installed, the membrane 14 of the sealing assembly 4 with its increased number of convolutions, is able to extend to a greater amount at the intersection of the curb and roadway portions of the deck sections 4, where such extension is required because of the increased width of the gap 12 due to its skew angle with the curb portion 6. The laterally extending convolutions 32 allow the membrane side portions to "rack", or compress on one side while lengthening at the other, to accommodate the skew angle through which the membrane must be turned at the intersection of the curb and roadway portions of the deck sections. Furthermore, the interrupted locking ribs 36, mating with the slots 20 in the pads 22, provide a firmly mechanical lock between the membrane 14 and the pads 22, that maintains the side edge portions of the membrane firmly in place on the recessed portions 10 of the deck sections 4. Lastly, the closed-cell Neoprene sponge filling 40 underneath each convolution 32 helps to seal out water and other debris, particularly at the difficult-to-seal intersection of the curb and roadway portions of the deck sections.

While only one embodiment of the present invention has been presented, other embodiments, modifications and additions will, of course, be apparent to those skilled in the art, without departing from the scope of the appended claims.

We claim:

1. An expansion joint sealing assembly for sealing a gap between adjacent deck sections at the intersection of curb and roadway portions of said deck sections, said sealing assembly including a first pair of elongated elastomeric pads designed for placement on said roadway portions of said deck sections along opposite sides of said gap, a second pair of elongated elastomeric pads designed for placement on said curb portions of said deck sections on opposite sides of said gap, an elongated flexible membrane member designed to extend across said gap between both said curb portions and said roadway portions of said deck sections, said flexible membrane member having longitudinally extending side edge portions designed to be secured between said pads and said deck sections, and means to secure said elongated pads to said deck sections with said side edge portions of said membrane member held between said pads and said deck sections, said assembly characterized by the improvement comprising:

(a) said side edge portions of said flexible membrane member each having molded convolutions with laterally extending axes, (b) each of said convolutions having an upwardly facing first rounded portion with a locking rib projecting upwardly from said first rounded portion, each of said locking ribs extending longitudinally of said membrane member and being separated from adjacent locking ribs by downwardly facing second rounded portions of said convolutions, and (c) said elongated elastomeric pads each having downwardly facing slots extending longitudinally of the respective pad, said locking ribs on said membrane member fitting within said slots in said elastomeric pads to hold said convoluted side edge portions of said membrane member in place between said pads and said deck sections.

2. The expansion joint sealing assembly according to claim 1 characterized also by the improvement comprising:

a closed-cell sponge filling affixed to the underside surfaces of said convolutions in the side edge portions of said flexible membrane member, the underside of said sponge filling designed for sealing contact with said deck section portions.

3. The expansion joint sealing assembly according to claim 1 or claim 2 characterized also by the improvement comprising:

two molded convolutions with longitudinally extending axes in the central part of said membrane member that is designed to extend over said gap between the roadway portions of said deck sections, said molded convolutions with longitudinally extending axes diverging away from one another toward the area of said membrane member that is designed to extend over said gap in the location of intersection of said curb and roadway portions of said deck sections, and at least one additional molded convolution with a longitudinally extending axis spaced between said first mentioned molded convolutions with longitudinally extending axes in said area of said membrane.

* * * * *